US006095768A

United States Patent [19]

Bianchi

[11] Patent Number: 6,095,768

[45] Date of Patent: Aug. 1, 2000

[54] HERMETIC MOTOR-DRIVEN COMPRESSOR FOR REFRIGERATORS

[75] Inventor: Vittorio Bianchi, Ferrera Di Varese, Italy

[73] Assignee: Embraco Europe S.r.l., Turin, Italy

[21] Appl. No.: 09/214,036

[22] PCT Filed: Apr. 23, 1998

[86] PCT No.: PCT/EP98/02409

§ 371 Date: Dec. 28, 1998

§ 102(e) Date: Dec. 28, 1998

[87] PCT Pub. No.: WO98/49447

PCT Pub. Date: Nov. 5, 1998

[30] Foreign Application Priority Data

Apr. 28, 1997 [IT] Italy ..... TO97A0363

[51] Int. Cl.[7] ..... F04B 35/04

[52] U.S. Cl. ..... 417/415; 417/372; 417/569

[58] Field of Search ..... 29/888.08; 417/415, 417/372, 569, 437, 542

[56] References Cited

U.S. PATENT DOCUMENTS

| | | | |
|---|---|---|---|
| 3,610,784 | 10/1971 | Rundell | 417/415 |
| 3,762,837 | 10/1973 | Ellis et al. . | |
| 3,906,603 | 9/1975 | Romer et al. | 29/888.08 |
| 4,325,679 | 4/1982 | Smith | 417/372 |
| 4,632,644 | 12/1986 | Fritchman | 417/415 |
| 4,718,830 | 1/1988 | Middleton et al. | 417/372 |
| 4,806,025 | 2/1989 | Kamiyama et al. . | |
| 4,834,627 | 5/1989 | Gannaway | 417/415 |
| 5,118,263 | 6/1992 | Fritcman | 417/415 |
| 5,149,254 | 9/1992 | Riffe | 417/569 |
| 5,205,723 | 4/1993 | Kawal et al. | 417/415 |
| 5,266,016 | 11/1993 | Kandpal | 417/569 |
| 5,403,170 | 4/1995 | Bianchi | 417/437 |
| 5,733,108 | 3/1998 | Riffe | 417/542 |
| 5,816,783 | 10/1998 | Oshima et al. | 417/415 |

FOREIGN PATENT DOCUMENTS

| | | |
|---|---|---|
| 0524552 | 1/1993 | European Pat. Off. . |
| 784937 | 10/1957 | United Kingdom . |

*Primary Examiner*—Teresa Walberg
*Assistant Examiner*—Leonid Fastovsky
*Attorney, Agent, or Firm*—Sughrue, Mion, Zinn, Macpeak & Seas, PLLC

[57] ABSTRACT

A motor-driven compressor unit (12) suspended in a hermetic housing (10) comprises a casing (24) which encloses the stator (16) of the electric motor externally and to which the stator is fixed. The casing (24) carries and is fixed firmly to a block (36) of the compressor and further comprises a transverse wall (28) situated at the opposite end to the block. The block (36) and the transverse wall (28) have respective annular seats (56, 60) concentric with the axis of rotation of the crankshaft (46). The annular seat (56) in the block (36) contains a main self-aligning bearing (86) and the annular seat (60) in the transverse wall (28) of the casing (24) contains a secondary self-aligning bearing (64).

14 Claims, 5 Drawing Sheets

HERMETIC MOTOR-DRIVEN COMPRESSOR FOR REFRIGERATORS

Figure 1:
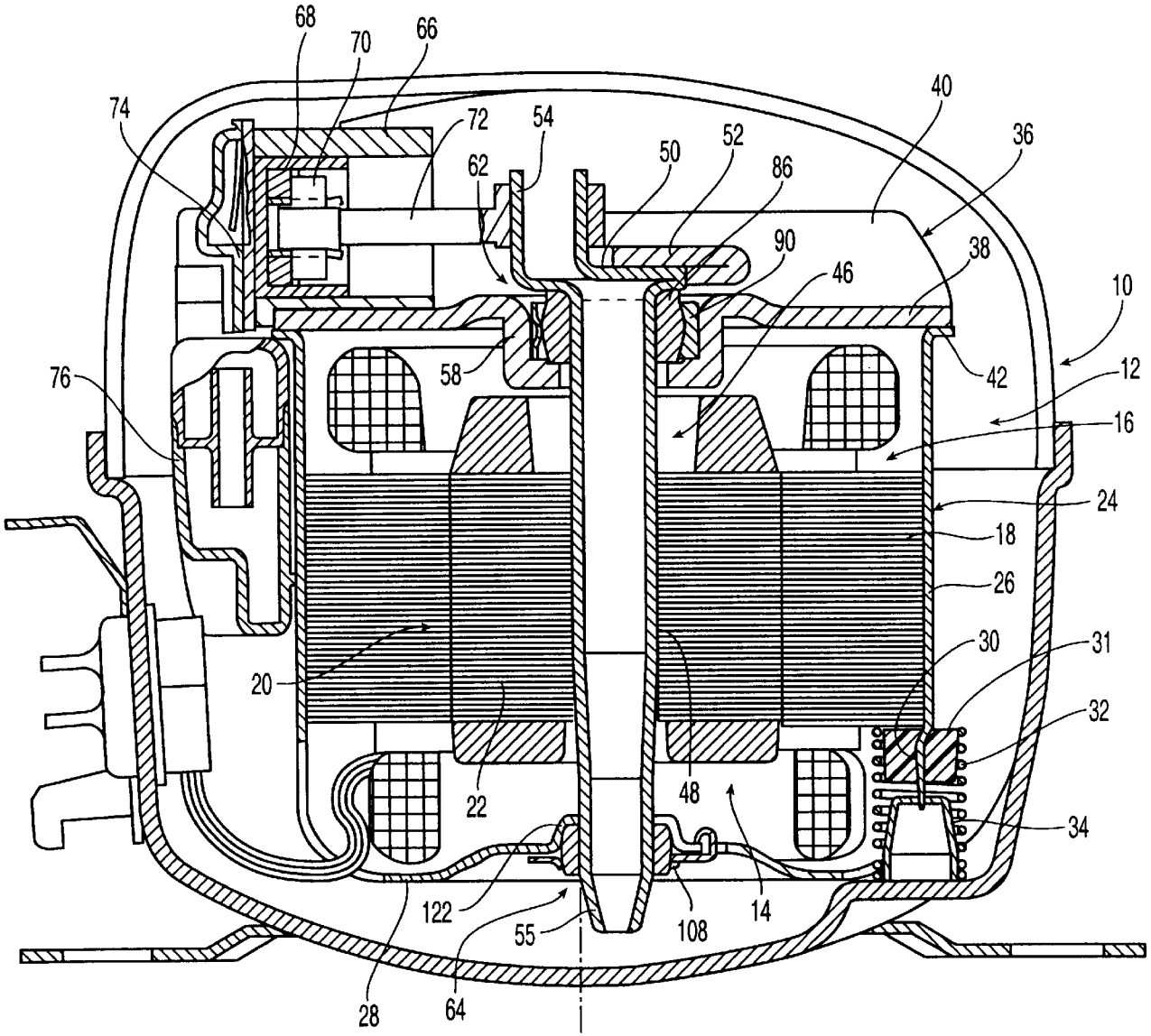

The present invention relates to a hermetic motor-driven compressor for refrigerators according to the preamble of claim 1.

The preamble of claim 1 describes a conventional compressor which is very common and has been known for very many decades.

One examples of such compressor is known from the document EP-A-0 524 552.

This known compressor comprises a single bearing constituted by a bush-like element which is fixed to the block and extends inside the rotor of the electric motor and in which the shaft of the compressor is mounted for rotation with a spheroidal coupling.

Since the rotor of the electric motor is fixed to a projecting portion of the shaft, the bush-like element and the portion of the shaft which co-operates therewith have to be of fairly generous dimensions with regard both to their diameters and to their lengths.

Amongst further countless examples of this arrangement, the documents DE-A-2 030 047, EP-A-0 507 091, EP-A-0 530 480, GB-A-771 194, GB-A-2 103 759, U.S. Pat. No. 3,295,753 and U.S. Pat. No. 4,386,856 may be cited.

The motor-driven compressor industry is tending to produce ever more efficient machines in order to reduce electrical-energy consumption for a given capacity.

One way of reducing energy consumption, in addition to that of increasing the thermodynamic efficiency of a compressor, is to reduce mechanical friction.

In the prior art, the coupling between the shaft and the single bearing constituted by the bush-like element of the block represents a source of considerable friction which it would be desirable to reduce.

The main object of the invention is precisely to provide a motor-driven compressor for refrigerators according to the preamble of claim 1 in which the friction of rotation of the crankshaft is reduced in comparison with the prior art.

According to the invention, this object is achieved by means of a motor-driven compressor having the characteristics defined in the characterizing part of claim 1.

In a motor-driven compressor according to the invention, the main self-aligning bearing, which is situated in the vicinity of the axis of the cylinder, withstands most of the forces developed between the piston and the crank pin of the shaft in operation; the secondary self-aligning bearing which is situated on the opposite side of the electric motor to the main bearing, however, is subject to very little stress, given that it is in a position remote from the axis of the cylinder.

This arrangement according to the invention enables a motor-driven compressor unit to be constructed with a crankshaft which, for a given power, has a smaller diameter than the shafts of similar units according to the most widespread prior art. This translates into a smaller circumference and axial length of the frictional surfaces of the bearings.

The mounting of the crankshaft by means of self-aligning bearings also offers the advantage that it enables the rotating parts (the crank-shaft and the rotor) to be centred easily relative to the fixed parts (the block, the casing and the stator). This results in a reduction in manufacturing costs.

Hermetic motor-driven compressors for refrigerators in which a block comprising two cylindrical bearings situated on either side of the crank pin of a crankshaft in an arrangement similar to that of small two-stroke reciprocating engines are also known, for example, from the documents GA-A-1 067 395 and EP-A-0 325 694.

In these less commonly-known motor-driven compressors, the rotor of the electric motor is again mounted on a projecting portion of the crankshaft, as in the more common motor-driven compressors according to the preamble of claim 1, and the two cylindrical bearings in practice have a function similar to that of the single long bush-like bearing, with corresponding relatively high friction.

Figure 2:
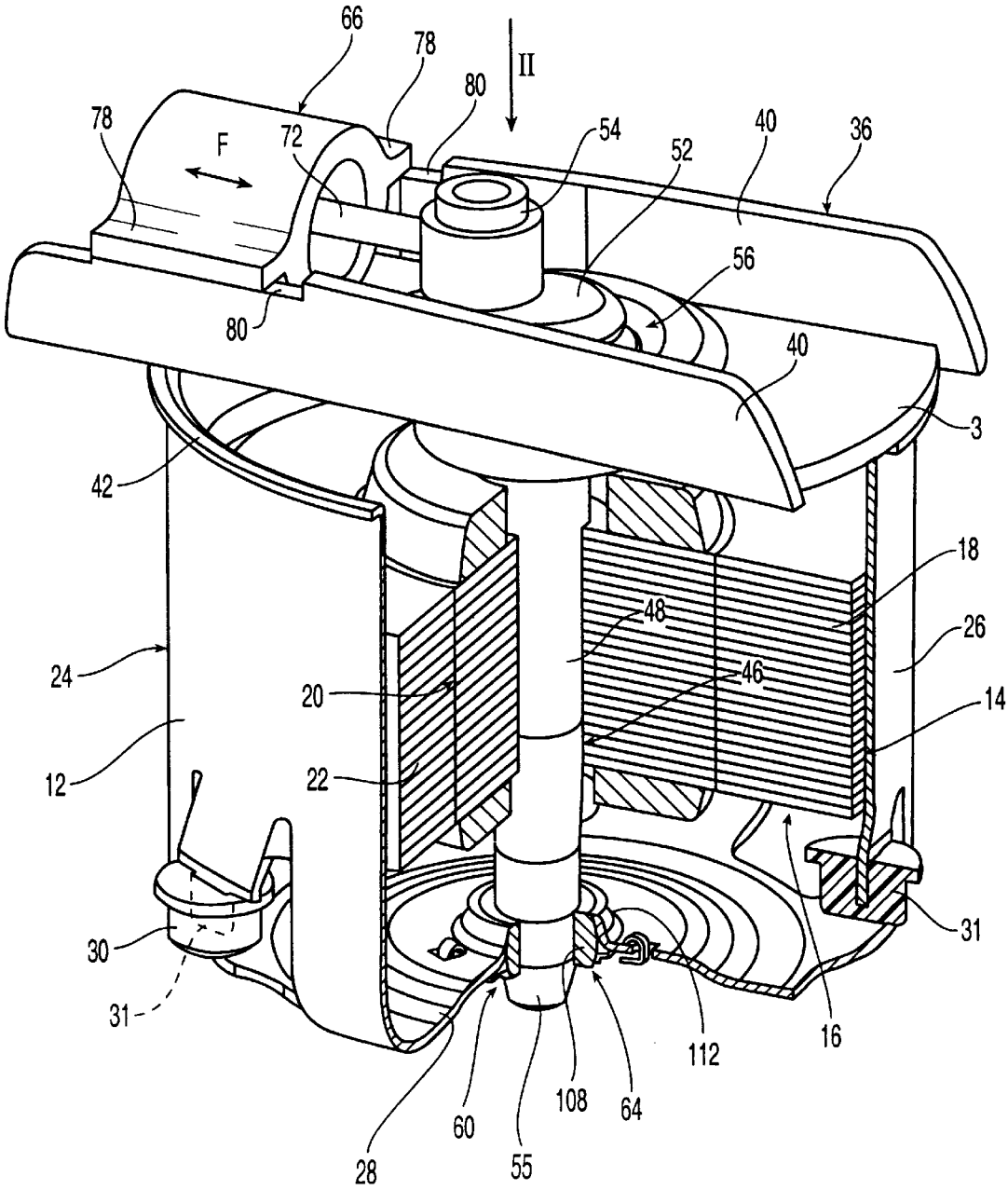
Figure 3:
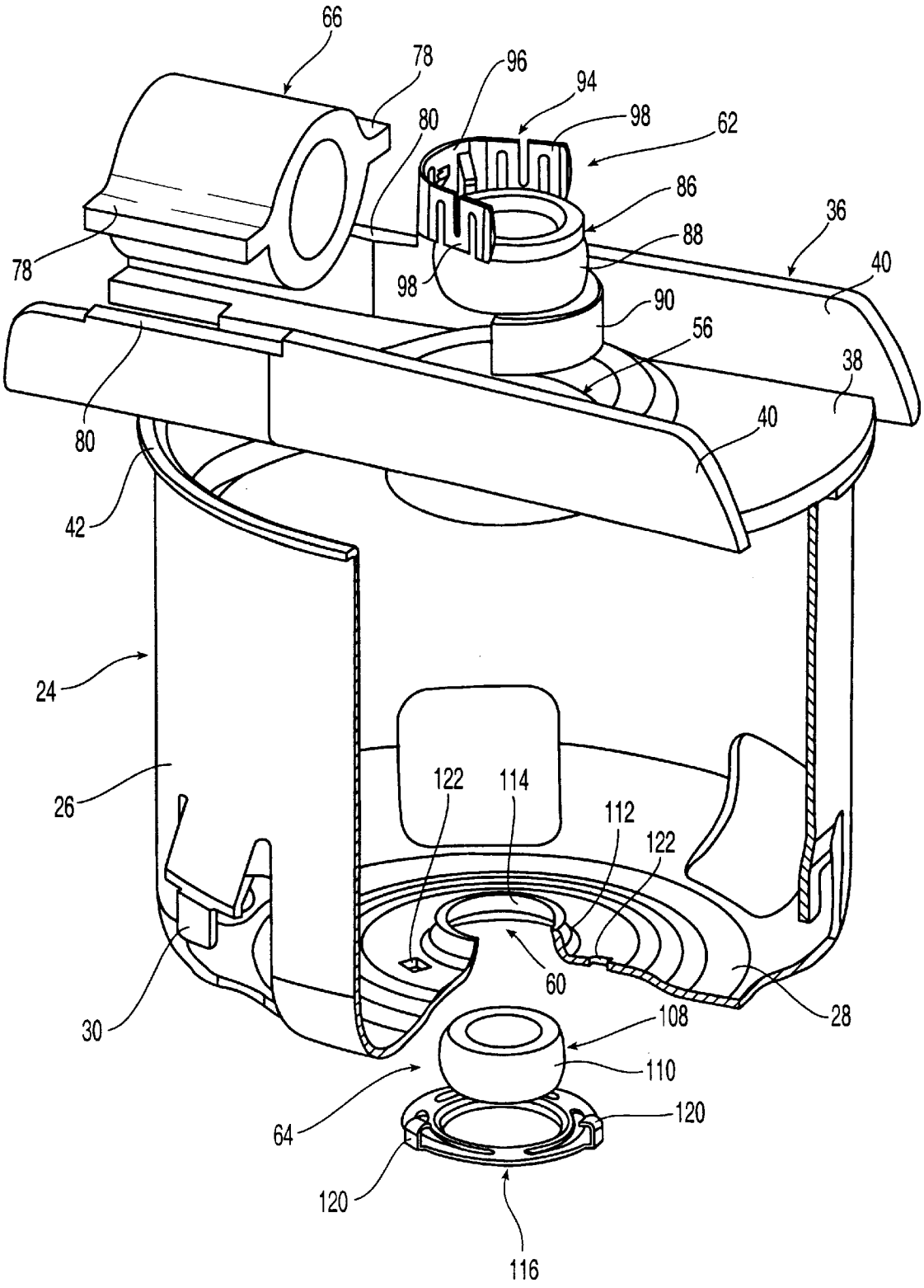
Figure 4:
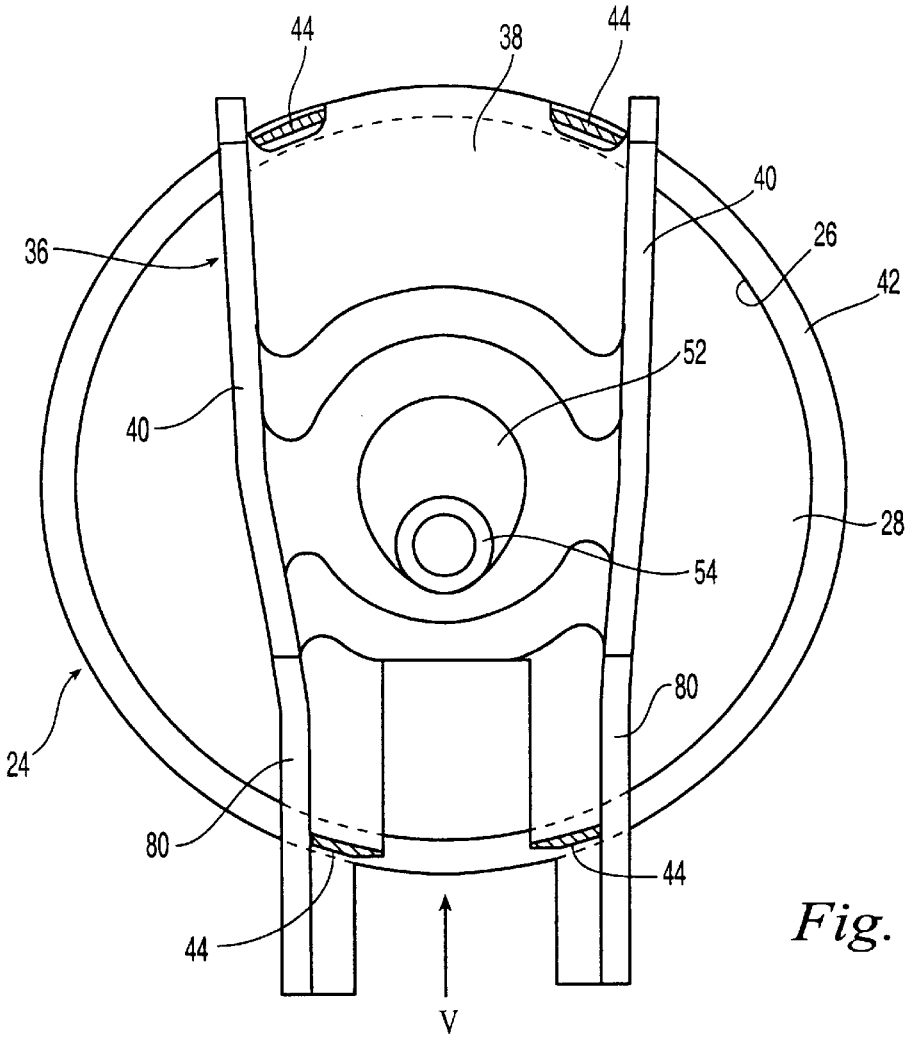
Figure 5:
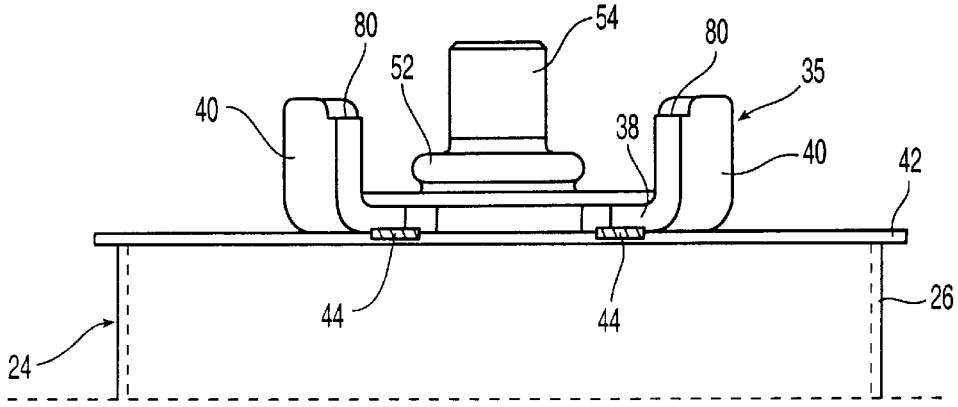
Figure 6:
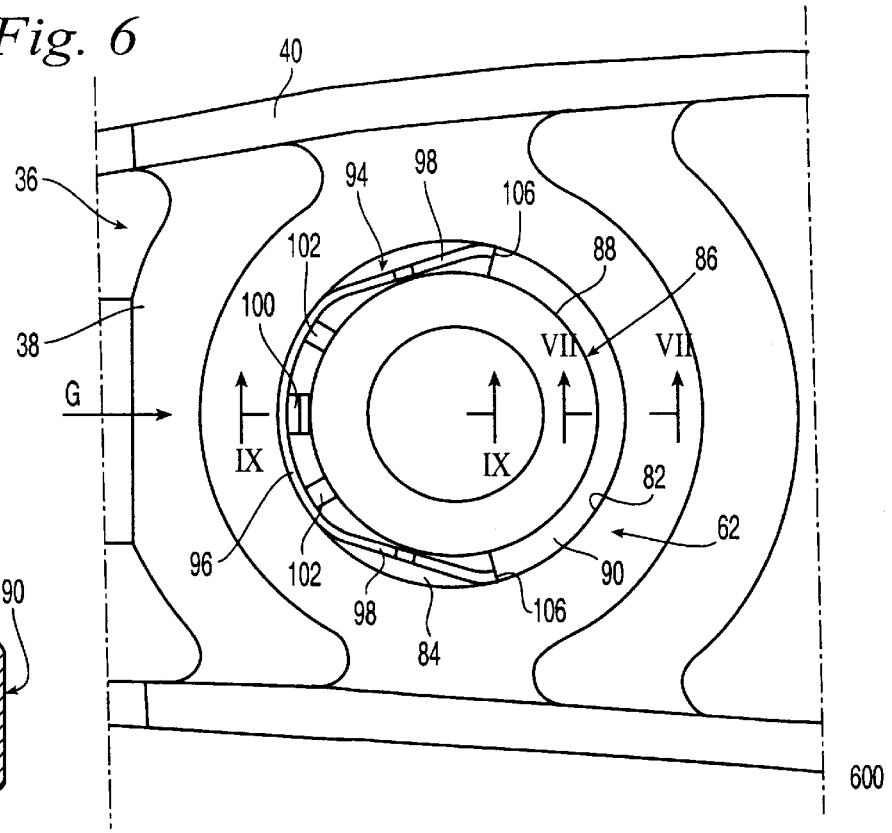
Figure 7:
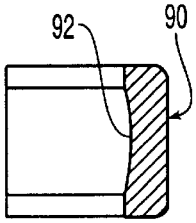
Figure 8:
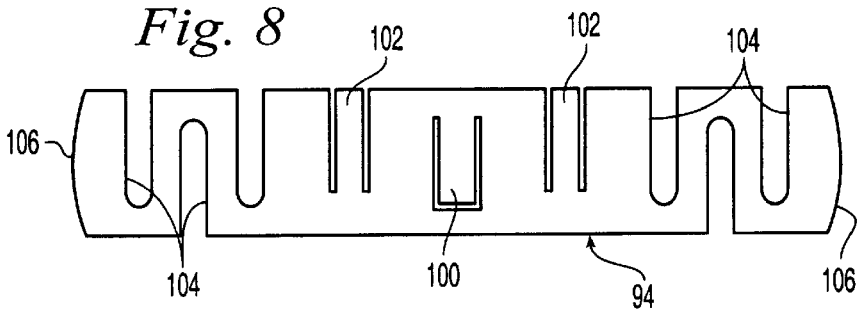
Figure 9:
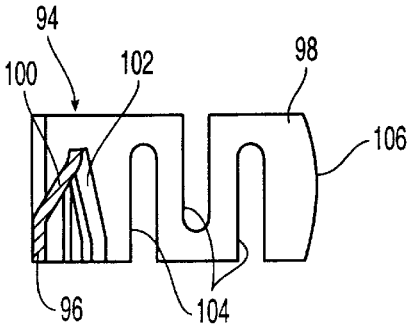
Figure 11:
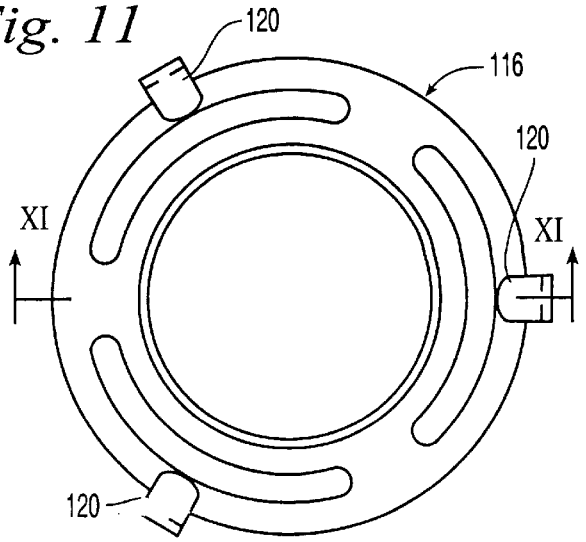
Figure 10:
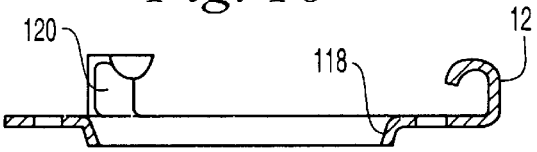

Further characteristics and advantages of the invention will become clear from a reading of the following detailed description with reference to the appended drawings, provided by way of non-limiting example, in which:

FIG. 1 is a diametral section of a hermetic motor-driven compressor according to the invention, FIG. 2 is a cut-away, perspective view of the principal internal components thereof, FIG. 3 is an exploded and cut-away perspective view showing some of these components, FIG. 4 is a plan view taken substantially along the arrow II of FIG. 2 but not showing the cylinder and the connecting rod of the compressor, FIG. 5 is a partial side view taken according to the arrow V of FIG. 4, FIG. 6 is a view of the central portion of FIG. 4 on an enlarged scale but without the crankshaft of the compressor, showing the assembly details of a main bearing, FIG. 7 is a diametral section of a detail indicated VII—VII in FIG. 6, showing an outer element of the main bearing, FIG. 8 shows a resilient loading element forming part of the main bearing, extended in the form of a blade, FIG. 9 is a median section taken as indicated IX—IX in FIG. 6, showing the resilient loading element alone, FIG. 10 is a plan view of a washer forming part of a secondary bearing of the compressor, and FIG. 11 is a diametral section of the washer, taken as indicated XI—XI in FIG. 10.

Reference will not be made mainly to FIG. 1, and to FIGS. 2 to 5 for the parts shown therein.

These drawings show a compressor of the type in which, in the installed condition, the axis of the crankshaft is vertical and the axis of the cylinder is horizontal but the invention is not limited to this arrangement.

With reference in particular to FIG. 1, a hermetic motor-driven compressor for refrigerators according to the invention comprises a hermetic housing of known type, generally indicated 10. A motor-driven compressor unit, also shown in FIG. 2 and generally indicated 12, is suspended in the housing 10.

The motor-driven compressor unit 12 comprises an electric motor, generally indicated 14, with a vertical axis.

The electric motor 14 comprises a wound stator 16 which has a pack of laminations 18 and which will be referred to further below.

Inside the stator 16 there is a squirrel-cage rotor 20 with a pack of laminations 22.

With reference again to FIGS. 1 to 5, according to the invention, the motor-driven compressor comprises a casing, generally indicated 24, which encloses the stator 16 externally and to which the pack of laminations 18 is fixed.

As shown, the casing 24 is preferably in the form of a cup-shaped container with a substantially cylindrical peripheral skirt 26 and with a transverse base wall 28 which will be referred to further below.

Shaped tabs 30, visible in FIGS. 1, 2 and 3, are formed in the skirt 26 by partial blanking and bending.

These tabs 30 are fitted in respective inserts 31 visible in FIGS. 1 and 2. The inserts 31 are fitted in respective helical suspension springs 32 which in turn are fitted around inverted cup-shaped locating elements 34 fixed to the base of the hermetic housing 10.

A block of the compressor, generally indicated 36 and visible in all of FIGS. 1 to 5, is fitted on the casing 24.

The block 36 is preferably constituted by a thick, blanked, bent and drawn sheet-metal part, as shown. In particular, the block 36 extends over the casing 24 like a diametral cross member and is channel-shaped.

The channel-shape is defined by a web 38 and by a pair of side flanges 40 which project from the face of the web 38 farther from the casing 24.

At the opposite end to the base wall 28, the casing 24 has a rim or flange 42 to which the web 38 of the block 36 is fixed by welds indicated 44 in FIGS. 4 and 5.

The welds 44 may advantageously be formed by the capacitive discharge system.

A crankshaft, generally indicated 46, is mounted concentrically in the casing 24.

The crankshaft 46 is of a generally known, tubular type comprising a straight portion 48, a crank 50 with a counterweight 52, and a crank pin 54.

A frusto-conical lower end of the straight portion 48 is indicated 55 and, in operation, dips into the oil in the lower portion of the housing 10, picking it up for the purpose of lubricating the couplings between the various parts which are moved relative to one another and which will be referred to further below.

The crank 50, its counterweight 52, and its crank pin 54 are disposed on the outside of the block 36, in particular, above the web 38.

According to the invention, the block 36 and the transverse or base wall 28 of the casing 24 have respective annular seats concentric with the axis of rotation of the shaft 46.

The annular seat of the block 36, indicated 56, is defined by a drawn central portion 58 of the web 38; the annular seat of the base wall 28 is indicated 60. Its structure will be mentioned further below.

The annular set 56 of the block 36 contains a main self-aligning bearing 62 and the annular seat 60 of the base wall 28 contains a secondary self-aligning bearings 64. The details of the self-aligning bearings 62 and 64 will be specified below.

A cylinder 66 of the compressor, in which a piston 68 is slidable, is fixed to the block 36. In the assembled condition, the axis of the piston 66 intersects the axis of the crankshaft 46 perpendicularly.

A gudgeon pin 70 or other articulation member such as a ball, fixed in the piston 68, is connected to the crank pin 54 by a connecting rod 72.

The cylinder 66 has a head valve-plate 74 to which an induction silencer 76 is fixed in known manner.

The cylinder 66 is preferably constituted by a sleeve-like element, for example, of sintered metal, with two diametrally-opposed outer longitudinal ribs 78, as shown in FIGS. 2, and 3.

Towards one end of the cross-member constituted by the block 36, its side flanges 40 have parallel and coplanar bearing edges 80 on which the ribs 78 are fitted in the manner shown in FIG. 2.

The arrangement is such as to enable the cylinder 66 and the block 36 to be assembled by an operation which comprises, as a first step, bringing the ribs 78 and the bearing edges 80 into engagement. In this first step, the piston 68 is already housed in the cylinder 66 and is already coupled to the connecting rod 72 by means of the gudgeon pin 70. Whilst the cylinder 66 is fitted on the block 36, the big end of the connecting rod 72 is engaged with the crank pin 54.

The unit comprises at least the cylinder 66, its valve-plate 74, and its head is preferably pre-assembled and checked before the cylinder 66 is assembled with the block 36.

In a subsequent step, whilst the cylinder 66 is simply bearing on the surfaces 80 by means of its ribs 78, it can be slid backwards and forwards along its axis on the flanges 40, as indicated by the arrow F in FIG. 2, until a predetermined adjustment position of the distance of the cylinder 66 from the shaft 46 is reached, in order to adjust the distance between the piston 68 and the valve-plate 74 in the outer dead-centre position of the piston 68.

Once this predetermined adjustment position is reached, as a last step of the assembly operation, the ribs are welded or glued to the bearing surfaces 80.

The details of the main self-aligning bearing 62 will now be described with reference to FIGS. 6 and 8.

The annular seat 56 of the main bearing has a substantially cylindrical peripheral surface 82 and a substantially flat annular base surface 84.

The main self-aligning bearing 62 comprises an inner bush-shaped element 86 which surrounds the upper part of the straight portion 48 of the crankshaft 46.

The inner element 86 has a convex spherical outer surface 88 which is symmetrical with respect to an equatorial median plane of the inner element 86. The main self-aligning bearing 62 also comprises an outer curved element 90. The outer element 90 is interposed between the bush 88 and the peripheral surface 82 of the set 56 in the region farther from the cylinder 66 and has a concave spherical inner surface 92 (FIG. 7). The inner element 86 is coupled spheroidally with this concave surface 92.

The main self-aligning bearing 62 further comprises a resilient loading element, generally indicated 94. The element 94 is interposed between the inner element 86 and the peripheral wall 82 of the seat 62 in the region closer to the cylinder 66.

In the preferred embodiment shown in FIGS. 3, 6, 8 and 9, the resilient loading element 94 is in the form of a substantially C-shaped blade.

As shown in FIG. 8, the blade-like element 94 is made from a strip of resilient sheet metal, blanked and subsequently shaped (FIGS. 3, 6 and 9).

In particular, the outer curved element extends around the inner element 86 through an arc slightly smaller than 180° and the blade-like resilient loading element 94 extends around the rest of the inner element 86.

The resilient loading element 94 comprises a rear portion 96 and two opposed side jaws 98.

The rear portion 96 bears against the peripheral surface 82 of the seat 56 in the region closest to the cylinder 66 and the ends of the side jaws 98 bear against corresponding side ends of the outer curved element 90.

A central resilient tab 100 and a pair of lateral resilient tabs 102 are formed by blanking and bending in the strip constituting the resilient loading element 94. The tabs 100, 102 bear against the spherical surface 88 of the inner element 86 from both sides of its equatorial plane, on the one hand in order to keep it firmly in a centred position in its seat 56, and on the other hand to keep the element 86 in resiliently yielding engagement with the concave spherical surface 92 (FIG. 7) of the outer element 90.

The jaws 98 preferably have partial transverse notches 104 to increase their flexibility, as shown.

As illustrated in FIGS. 8 and 9, the ends 106 of the jaws 98 of the blade 94 have an arcuate shape to ensure that they fit the ends of the inner curved element 90.

A main self-aligning bearing 62 having a structure such as that shown in FIG. 6 is advantageous in comparison with conventional self-aligning bearings in the application in question.

A conventional self-aligning bearing comprises an inner element of the same type as that illustrated with an outer spherical surface. Its outer element, however, is constituted by two half-shells which meet in an equatorial plane. The two half-shells together define an inner spherical surface for coupling with the inner bush.

When used in a motor-driven compressor unit, the main self-aligning bearing 62 is subject to a relatively large force along the axis of the piston in the direction indicated by the arrow G in FIG. 6 during the compression and exhaust stroke. This force G would tend to separate the two half-shells of an outer element of a conventional self-aligning bearing.

On the other hand, the forces in the opposite direction to the arrow G which are developed during the intake stroke in a motor-driven compressor for refrigerators and the like are relatively weak.

In the structure of the main bearing 62 shown in FIGS. 6 to 9, the large forces which act in the direction of the arrow G of FIG. 6 are absorbed, by means of the concave spherical surface 92, by the curved element 90 which, since it is not in two parts, does not tend to open out from the equatorial plane; the forces acting in the opposite direction to the arrow G which are relatively weak, on the other hand, are advantageously absorbed by the resilient tabs 100 and 102.

The resilient assembly of the main bearing 62 can also take up play, which can be small since the tolerances of alignment of the bearings can be quite large, to the benefit of manufacturing costs.

Before going on to the description of a preferred embodiment of the secondary self-aligning bearing 64, it is pointed out that, whatever structure is adopted for this bearing, it suffices for this structure to be quite rudimentary since its function is little more than to keep the crankshaft 46 and the rotor 20 centred relative to the stator 16; the forces in play are in fact absorbed to a largely predominant extent by the main bearing 62 which is very close to the axis of the cylinder 66.

Reference will now be made to FIGS. 2, 3, 10 and 11 to describe the preferred structure of the secondary self-aligning bearing 64.

The secondary self-aligning bearing 64 also comprises an inner bush-shaped element 108 through which the straight portion 48 of the crankshaft 46 extends.

The bush 108 also has an outer spherical surface 110 which is symmetrical with respect to an equatorial plane.

The secondary bearing 64 also comprises an outer element constituted simply by a central annular projection 112 formed in the base wall 28 of the casing 24.

The projection 112 has a generally concave spherical inner surface 114 (FIG. 3) corresponding to that of the inner element 108.

A blanked and drawn sheet-metal washer 116 is associated with the secondary bearing 64.

As shown in FIGS. 10 and 11, the washer 116 has a shaped radially inner rim 118 which engages the axially outermost portion of the inner element 108.

The washer 116 serves to retain the inner element 108 of the bearing 62 the seat 64 of which is formed jointly by the annular projection 112 and by the rim 118.

The washer 116 has a crown of three hook-shaped tongues 120 on its periphery. These tongues 120 are hooked onto corresponding edges of holes 122 (FIG. 3) cut in the base wall 28.

What is claimed is:

1. A hermetic motor-driven compressor for refrigerators, comprising:

a hermetic housing (10), and a motor-driven compressor unit (12) suspended in the housing (10) and in turn comprising:

an electric motor (14) with a stator (16) and a rotor (20) defining an axis of rotation, a compressor block (36) situated at one axial end of the motor (14), fixed to the stator (16), and incorporating a bearing (62) centred on the axis of rotation, a crankshaft (46) comprising a straight portion (48) which extends through the rotor (20) along the axis of rotation, is fixed to the rotor, and extends through the bearing (62) of the block (36) with a spheroidal coupling, the crankshaft (46) further comprising a crank (50) situated on the farther side of the block (36) from the motor (14) and having a crank pin (54), a compressor cylinder (66) fixed to the block (36) in the region of the crank (50) and having an axis which intersects the axis of rotation perpendicularly, a piston (68) slidable to and fro in the cylinder (66) and incorporating an articulation member (70), and a connecting rod (72) which interconnects the crank pin (54) and the articulation member (70) of the piston, characterized in that it comprises a casing (24) which encloses the stator (16) of the electric motor (14) externally and to which the stator is fixed, the casing (24) carrying and being fixed firmly to the block (36) of the compressor and further comprising a transverse wall (28) which is situated at the opposite end to the block (36) and is intersected by the axis of rotation, and through which the straight portion (48) of the crankshaft (46) extends, and in that the block (36) and the transverse wall (28) have respective annular seats (56, 60) which are concentric with the axis of rotation, and of which the annular seat (56) of the block (36) contains a main self-aligning bearing (62) and the annular seat (60) of the transverse wall (28) of the casing (24) contains a secondary self-aligning bearing (64), the straight portion (48) of the crankshaft (46) being mounted in both of these bearings (62, 64).

2. A motor-driven compressor according to claim 1, characterized in that the annular seat (56) of the main self-aligning bearing (62) has a substantially cylindrical peripheral surface (82) for housing the bearing and a substantially flat annular base surface (84), in that the main bearing (62) comprises an inner bush-shaped element (86) which surrounds the straight portion (48) of the crankshaft (46) and has a convex spherical outer surface (88) symmetrical with respect to a median equatorial plane and a curved outer element (90) interposed between the bush (86) and the peripheral surface (82) of the seat (56) in a region farther from the cylinder (66) and having a concave spherical inner surface (82) with which the inner element (86) is coupled spheroidally, and in that the main bearing (62) further comprises a resilient loading element (94) interposed between the inner element (86) of the bearing (62) and the peripheral surface (82) of the seat (56) in a region closer to the cylinder (66) and during the spherical surface (88) of the inner element (86) into resiliently yielding engagement with the spherical concave surface (92) of the outer curved element (90).

3. A motor-driven compressor according to claim 2, characterized in that the outer curved element (90) of the main bearing (62) extends around the inner element (86) through an arc approximately 180° and the resilient loading element (94) is in the form of a substantially C-shaped blade which extends around the rest of the inner element (86) with a rear portion (96) which bears against the peripheral surface (82) of the seat (56) in the region closer to the cylinder (66) and with two opposed lateral jaws (98) the ends (106) of which bear against corresponding lateral ends of the outer curved element (90), and in that the shaped blade (94) has resilient tabs (100, 102) which bear against the spherical surface (88) of the inner element (86) on the two sides of its equatorial plane.

4. A motor-driven compressor according to claim 3, characterized in that the rear portion (96) of the shaped blade (94) has a central resilient tab (100) which engages the spherical inner surface (88) of the inner element (86) on one side of the equatorial plane and a pair of lateral tabs (102) arranged symmetrically with respect to the axis of the cylinder (66) and engaging the spherical surface (88) from the other side of the equatorial plane.

5. A motor-driven compressor according to claim 3, characterized in that the jaws (98) of the blade (94) have transverse partial notches (104) for improving their flexibility.

6. A motor-driven compressor according to claim 1, characterized in that the block (36) is constituted by an element fitted on and fixed to the casing (24).

7. A motor-driven compressor according to claim 6, characterized in that the casing (24) is in the form of a cup-shaped container with a substantially cylindrical peripheral skirt (26), with a base wall (28) having the seat (60) for the secondary self-aligning bearing (64) in its centre, and with a rim (42) which is situated at the opposite end to the base wall (28) and to which the block (36) is fixed.

8. A motor-driven compressor according to claim 7, characterized in that the casing (24) is constituted by a single deep-drawn piece of sheet-metal, and in that shaped tabs (30) for coupling with springs (32) for suspending the casing (24) in the housing (10) of the compressor are formed by partial blanking and bending in the skirt (26) of the casing (24).

9. A motor-driven compressor according to claim 8, characterized in that the secondary self-aligning bearing (64) comprises an inner bush-shaped element (108) through which the straight portion (48) of the crankshaft (46) extends and which has a spherical outer surface (110) substantially symmetrical with respect to an equatorial plane, and an outer element defined by a shaped annular projection (112) formed in the base wall (28) by drawing and having an inner spherical surface (114), and in that a blanked and drawn sheet-metal washer (116) associated with the secondary bearing (64) is fixed to the base wall (28) and has a shaped radially inner rim (118) for engaging the axially outermost portion of the inner element (108).

10. A motor-driven compressor according to claim 9, characterized in that the washer (116) has, on its periphery, a crown of hook-shaped tabs (12) which are hooked onto corresponding edges of openings (122) cut in the base wall (28) of the casing (24).

11. A motor-driven compressor according to claim 6, characterized in that the element which is fitted on and which constitutes the block (36) extends over the casing (24) like a diametral cross-member and is channel-shaped with a web (38) fixed to the casing (24) and having, formed in its centre, a well (56) having a hole in its base and constituting the seat for the main self-aligning bearing (62), and with a pair of side flanges (40) projecting from the face of the web 38) farther from the casing (24), in that, towards one end of the cross-member (36), the side flanges (40) have parallel and coplanar bearing edges (80), and in that the cylinder (66) is constituted by a sleeve-like element with two diametrally-opposed outer longitudinal ribs (78) for the support of the cylinder (66) on the bearing edges (80) and its fixing thereto, the arrangement being such as to enable the cylinder (66) and the block (36) to be assembled by an operation which comprises the successive steps of bringing the ribs (78) and the bearing edges (80) into engagement, possibly sliding the cylinder (66) along its axis along the bearing edges (80), and fixing the ribs (78) and the flanges (40) to one another in a predetermined adjustment position of the distance of the cylinder (66) from the axis of the crankshaft (46).

12. A motor-driven compressor according to claim 11, characterized in that the block (36) is constituted by a piece of blanked, bent and drawn sheet metal.

13. A motor-driven compressor according to claim 9, characterized in that, when the cylinder (66) is in the said predetermined adjustment position, its ribs (78) and the side flanges (40) of the block (36) are fixed together by welding.

14. A motor-driven compressor according to claim 9, characterized in that, when the cylinder (66) is in the said predetermined adjustment position, its ribs (78) and the side flanges (40) of the block (36) are fixed together by glueing.

* * * * *